US007609998B2

(12) United States Patent
Katoh et al.

(10) Patent No.: US 7,609,998 B2
(45) Date of Patent: Oct. 27, 2009

(54) TRANSFER UNIT AND IMAGE FORMING APPARATUS

(75) Inventors: Tsutomu Katoh, Kanagawa (JP); Mitsuru Takahashi, Kanagawa (JP); Kazuchika Saeki, Kanagawa (JP); Nobuto Yokokawa, Kanagawa (JP); Kazuosa Kuma, Kanagawa (JP); Takeshi Fukao, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 209 days.

(21) Appl. No.: 11/759,657

(22) Filed: Jun. 7, 2007

(65) Prior Publication Data

US 2007/0286640 A1 Dec. 13, 2007

(30) Foreign Application Priority Data

Jun. 13, 2006 (JP) ..... 2006-163349

(51) Int. Cl.
*G03G 15/16* (2006.01)

(52) U.S. Cl. ..... 399/121; 399/162; 399/302; 399/313

(58) Field of Classification Search ..... 399/121, 399/302, 303, 308, 313, 162, 167
See application file for complete search history.

(56) References Cited

U.S. PATENT DOCUMENTS

| | | | | |
|---|---|---|---|---|
| 5,075,731 | A * | 12/1991 | Kamimura et al. | 399/302 X |
| 5,467,171 | A * | 11/1995 | Castelli et al. | 399/162 |
| 5,689,764 | A * | 11/1997 | Fukuchi et al. | 399/167 X |
| 5,761,580 | A * | 6/1998 | Harada et al. | 399/167 |
| 5,774,767 | A * | 6/1998 | Shibata et al. | 399/167 |
| 6,600,895 | B2 * | 7/2003 | Fletcher et al. | 399/308 X |
| 6,865,361 | B2 * | 3/2005 | Abe et al. | 399/302 |
| 2003/0223777 | A1 * | 12/2003 | Ogashiwa et al. | 399/121 |
| 2004/0151518 | A1 * | 8/2004 | Mizoguchi | 399/167 |
| 2006/0088338 | A1 * | 4/2006 | Matsuda et al. | 399/167 |
| 2006/0193656 | A1 * | 8/2006 | Kumazawa | 399/121 |

FOREIGN PATENT DOCUMENTS

| | | |
|---|---|---|
| JP | 8-129310 | 5/1996 |
| JP | 2000-56620 | 2/2000 |
| JP | 2001-75376 | 3/2001 |
| JP | 2001-100537 | 4/2001 |
| JP | 2002-14570 | 1/2002 |
| JP | 2002-236422 | 8/2002 |
| JP | 2004-108412 | 4/2004 |
| JP | 2004-118100 | 4/2004 |
| JP | 2004-151389 | 5/2004 |

(Continued)

OTHER PUBLICATIONS

Machine translation of JP 2005-091810 A dated Feb. 25, 2009.*

*Primary Examiner*—Sophia S Chen
(74) *Attorney, Agent, or Firm*—Oblon, Spivak, McClelland, Maier & Neustadt, L.L.P.

(57) ABSTRACT

A transfer belt is driven by a plurality of supporting rollers. A unit frame supports the supporting rollers in a rotatable manner. At least one of the supporting rollers includes a cylindrical member having a substantially same outer diameter over an entire length thereof. Each end portion of the cylindrical member in a longitudinal direction is supported by the unit frame via a bearing in a rotatable manner.

10 Claims, 12 Drawing Sheets

FOREIGN PATENT DOCUMENTS

| | | | | |
|---|---|---|---|---|
| JP | 2004-184450 | | | 7/2004 |
| JP | 2004-279568 | | | 10/2004 |
| JP | 2005-31504 | | | 2/2005 |
| JP | 3659462 | B2 | | 3/2005 |
| JP | 2005-091810 | A | * | 4/2005 |

* cited by examiner

TRANSFER UNIT AND IMAGE FORMING APPARATUS

CROSS-REFERENCE TO RELATED APPLICATIONS

The present document incorporates by reference the entire contents of Japanese priority document, 2006-163349 filed in Japan on Jun. 13, 2006.

BACKGROUND OF THE INVENTION

1. Field of the Invention

The present invention relates to a transfer unit including a plurality of supporting rollers, a transfer belt wound around the supporting rollers to be driven for rotation, and a unit frame rotatably supporting the supporting rollers, and an image forming apparatus including the transfer unit.

2. Description of the Related Art

It has been conventionally known that the transfer unit of the type mentioned above is adopted into an image forming apparatus configured as, for example, an electronic copier, a printer, a facsimile machine, or a Multifunctional Peripheral (MFP) with at least two of these functions. Such an image forming apparatus can be broadly divided into an intermediate transfer type and a direct transfer type. In the intermediate transfer type, a toner image formed on an image carrier is transferred onto a transfer belt of a transfer unit for primary transfer, and the toner image on the transfer belt is then transferred onto a recorded medium for secondary transfer to obtain a recorded image. In the direct transfer type, a toner image formed on an image carrier is directly transferred onto a recording medium carried and conveyed by a transfer belt of a transfer unit to obtain a recorded image (see, for example, Japanese Patent Application Laid-Open No. 2004-151389 and Japanese Patent Application Laid-Open No. 2004-108412).

In the conventional transfer unit, a supporting roller around which a transfer belt is wound includes a cylindrical member and a pair of shaft members press-fitted inside the cylindrical member from an opening of each end in a longitudinal direction of the cylindrical member, and each shaft member is rotatably supported to a unit frame via a bearing. Here, if the center axis line of the shaft members is significantly decentered with respect to the center axis line of the cylindrical member, periodical speed fluctuations occur to the transfer belt wound around the supporting roller and driven for rotation, thereby causing density unevenness in a toner image transferred on a recording medium. In the case of an image forming apparatus that forms a full-color image, a color shift occurs to the toner image on the recording medium. To get around this problem, the shaft members are required to be manufactured so that the center axis line of the shaft members accurately matches with the center axis line of the cylindrical member. Manufacturing cost of such shaft members, however, is high. Therefore, the conventional transfer unit inevitably has a drawback of increasing cost.

SUMMARY OF THE INVENTION

It is an object of the present invention to at least partially solve the problems in the conventional technology.

A transfer unit according to one aspect of the present invention includes a plurality of supporting rollers; a transfer belt that is driven by the supporting rollers; and a unit frame that supports the supporting rollers in a rotatable manner. At least one of the supporting rollers includes a cylindrical member having a substantially same outer diameter over an entire length thereof. Each end portion of the cylindrical member in a longitudinal direction is supported by the unit frame via a bearing in a rotatable manner.

An image forming apparatus according to another aspect of the present invention includes a transfer unit that includes a plurality of supporting rollers, a transfer belt that is driven by the supporting rollers, and a unit frame that supports the supporting rollers in a rotatable manner; and an image carrier on which a toner image is formed. At least one of the supporting rollers includes a cylindrical member having a substantially same outer diameter over an entire length thereof. Each end portion of the cylindrical member in a longitudinal direction is supported by the unit frame via a bearing in a rotatable manner. The toner image formed on the image carrier is transferred onto a transfer belt of the transfer unit for a primary transfer, and the toner image on the transfer belt is transferred onto a recording medium for a secondary transfer to obtain a recorded image.

An image forming apparatus according to still another aspect of the present invention includes a transfer unit that includes a plurality of supporting rollers, a transfer belt that is driven by the supporting rollers, and a unit frame that supports the supporting rollers in a rotatable manner; and an image carrier on which a toner image is formed. At least one of the supporting rollers includes a cylindrical member having a substantially same outer diameter over an entire length thereof. Each end portion of the cylindrical member in a longitudinal direction is supported by the unit frame via a bearing in a rotatable manner. The toner image formed on the image carrier is transferred onto a recording medium carried by the transfer belt to obtain a recorded image.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

First, an example of an image forming apparatus is briefly explained in which a transfer unit according to the present invention is adopted.

Figure 1:
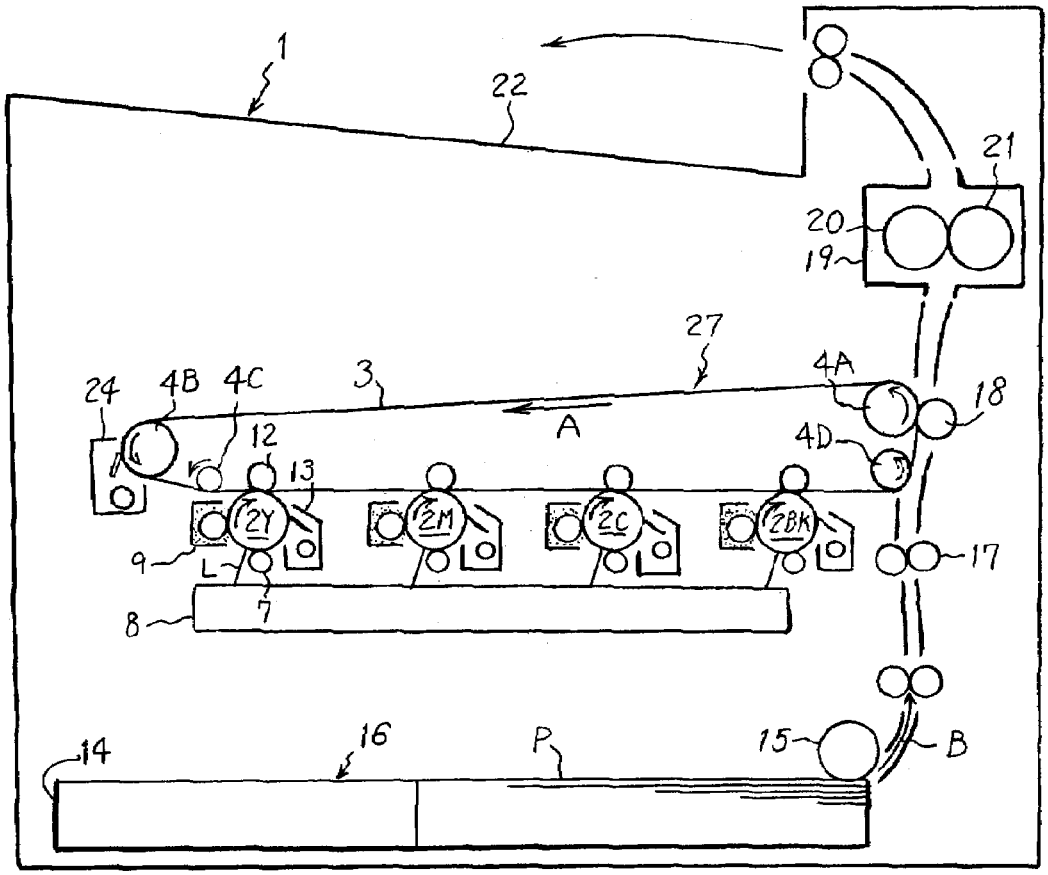
FIG. 1 is a schematic cross-section view of an image forming apparatus of an intermediate transfer type.
Figure 2:
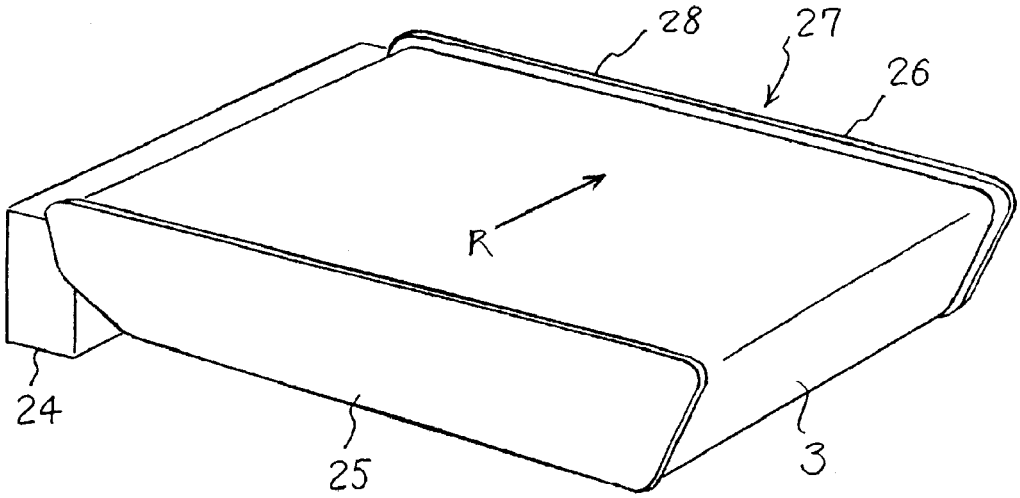
FIG. 2 is an external perspective view of a transfer unit.

FIG. 1 is a schematic cross-section view of an example of an image forming apparatus of an intermediate transfer type. The image forming apparatus depicted herein includes four image carriers 2Y, 2M, 2C, and 2BK formed of a drum-shaped photosensitive member disposed inside an image forming apparatus body 1, and a transfer unit 27 similarly disposed inside the image forming apparatus body 1. The outer view of the transfer unit 27 is as depicted in FIG. 2.

The transfer unit 27 includes a plurality of supporting rollers 4A, 4B, 4C, and 4D, a unit frame (not shown in FIG. 1) rotatably supporting these supporting rollers 4A to 4D, and a transfer belt 3 formed of an endless belt wound around the supporting rollers 4A to 4D. In the depicted example, the supporting roller 4A is formed as a driving roller, and other supporting rollers 4B, 4C, and 4D are formed as driven rollers. With the supporting roller 4A being driven by a driving motor not shown in a counterclockwise direction in FIG. 1, the transfer belt 3 is driven for rotation in a direction indicated by an arrow A in FIG. 1, and accordingly the other supporting rollers 4B, 4C, and 4D are driven for rotation in a counterclockwise direction.

On the other hand, the image carriers 2Y to 2BK of the first to fourth image carriers are driven for rotation in a clockwise direction in FIG. 1 while abutting on the transfer belt 3. At this time, the first image carrier 2Y is charged at a predetermined polarity by a charging roller 7. Next, a charging surface of the first image carrier 2Y is radiated with an optically-modulated laser beam L emitted from an optical unit 8. With this, an electrostatic latent image is formed on the image carrier 2Y. This electrostatic latent image is visualized by a developing device 9 as a yellow toner image. Also, a primary transfer roller 12 is disposed on an opposite side of the image carrier 2Y across the transfer belt 3. With a transfer voltage being applied to this transfer roller 12, the toner image on the image carrier 2Y is transferred onto the transfer belt 3 rotating in an arrow A direction for primary transfer. Residual transfer toner attached on the image carrier 2Y after toner image transfer is removed by a cleaning device 13.

In exactly the same manner, a magenta toner image, a cyan toner image, and a black toner image are formed on the second to fourth image carriers 2M, 2C, and 2BK, respectively. These toner images are sequentially transferred for primary transfer onto the transfer belt 3 on which the yellow toner image has been transferred, thereby forming a superposed toner image on the transfer belt 3.

On the other hand, at a lower portion inside the image forming apparatus body 1, a paper feeding cassette 14 having accommodated therein recording media P formed of, for example, transfer sheets or resin films, and a paper feeding device 16 having a paper feeding roller 15 are disposed. With the rotation of the paper feeding roller 15, a recording sheet P on top is sent in an arrow B direction. The sent recording medium is fed with the rotation of paired resist rollers 17 to a gap between the transfer belt 3 and a secondary transfer roller 18 facing thereto at a predetermined timing. At this time, a predetermined transfer voltage is applied to the secondary transfer roller 18, thereby causing the superposed toner image on the transfer belt 3 to be transferred onto the recording medium P for secondary transfer.

The recording medium having transferred thereon the superposed toner image for secondary transfer is further conveyed upward to pass through a gap between a fixing roller 20 and a pressure roller 21 of a fixing device 19, thereby the toner image on the recording medium to be fixed by the action of heat and pressure. The recording medium passing through the fixing device 19 is then delivered to a paper delivery unit 22 disposed at an upper portion of the image forming apparatus body 1. Residual transfer toner attached on the transfer belt 3 after toner image transfer is removed by a cleaning device 24.

The cleaning device 24 is coupled to a unit frame 28 of the transfer unit 27 as depicted in FIG. 2. The cleaning device 24 forms a part of the transfer unit 27. The transfer unit 27 formed as explained above is mounted inside the image forming apparatus body 1 so as to be able to be drawn toward the front, that is, in a direction vertical to a paper surface in FIG. 1. FIG. 2 depicts the state where the transfer unit 27 is taken out to the outside of the image forming apparatus body. With this transfer unit 27 being pressed in a depth direction of the image forming apparatus body as indicated by an arrow R, the transfer unit 27 can be positioned and mounted inside of the image forming apparatus body 1 as depicted in FIG. 1. In this manner, the transfer unit 27 is removably mounted on the image forming apparatus body 1.

As depicted in FIG. 2, the unit frame 28 includes the front side plate 25 positioned at the front side of the image forming apparatus body when the transfer unit 27 is mounted inside the image forming apparatus body, the rear side plate 26 positioned at the rear side of the image forming apparatus, and a stay not shown that integrally coupling these side plates 25 and 26. The primary transfer rollers disposed to face the image carriers 2Y, 2M, 2C, and 2BK are rotatably supported by the front side plate 25 and the rear side plate 26 of the unit frame 28. These primary transfer rollers form components of the transfer unit 27.

As explained above, an image forming apparatus of the intermediate transfer type includes a transfer unit and an image carrier on which a toner image is formed, and is configured such that a toner image formed on the image carrier is transferred onto a transfer belt of a transfer unit for primary transfer, and the toner image on the transfer belt is then transferred onto a recording medium for secondary transfer to obtain a recorded image. In place of providing a plurality of image carriers, only one image carrier may be provided to form an image forming apparatus of the intermediate transfer type.

Figure 3:
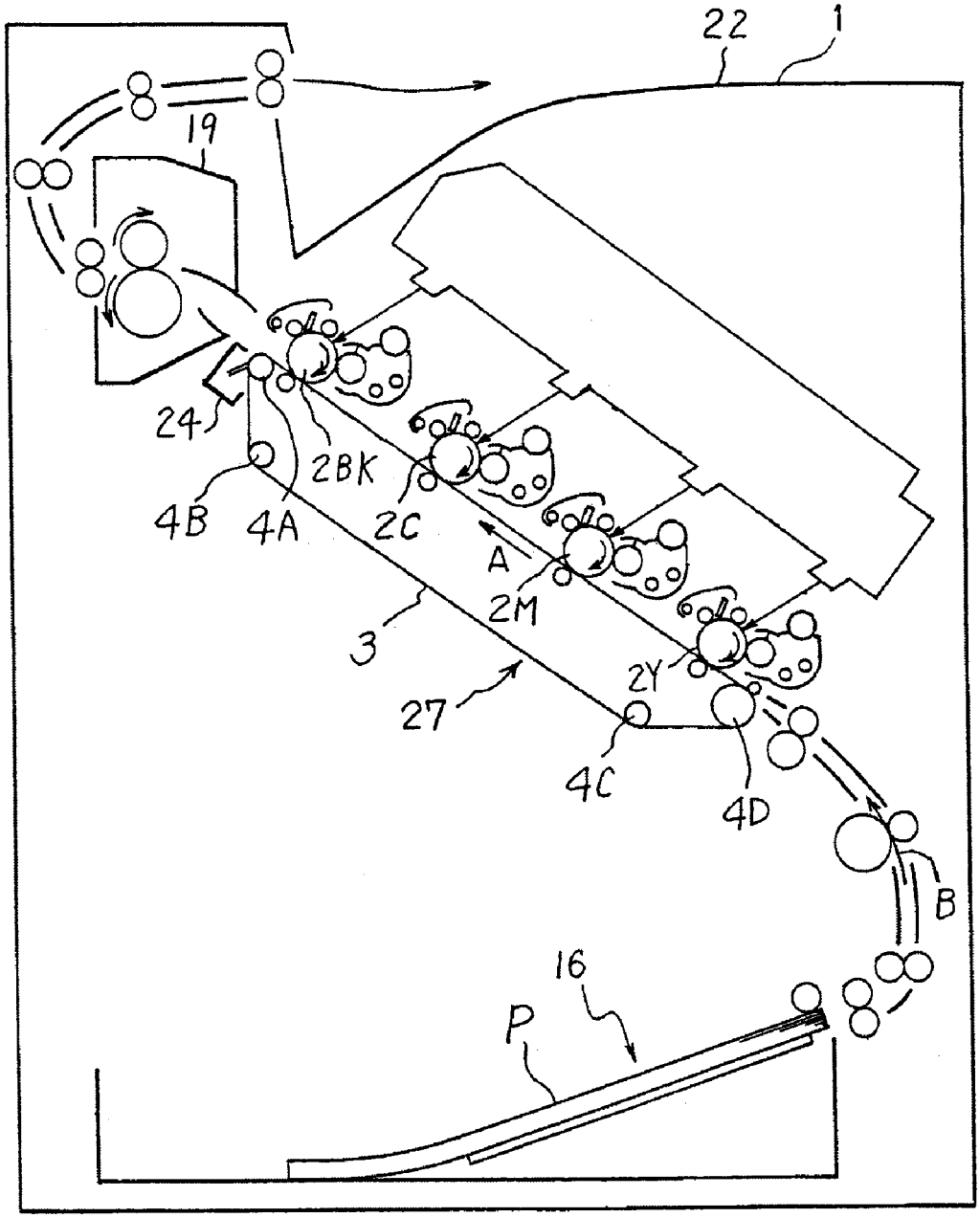
FIG. 3 is a schematic cross-section view of an image forming apparatus of a direct transfer type.

On the other hand, FIG. 3 is a schematic cross-section view of an example of an image forming apparatus of a direct transfer type. The image forming apparatus depicted herein also includes image carriers 2Y, 2M, 2C, and 2BK driven for rotation in a clockwise direction in FIG. 3 and the transfer unit 27 disposed to face these image carriers. This transfer unit 27 also includes a plurality of supporting rollers 4A, 4B, 4C, and 4D, the transfer belt 3 formed of an endless belt wound around the supporting rollers 4A to 4D, and a unit frame not shown rotatably supporting these supporting rollers 4A to 4D. With the rotation of the supporting roller 4A formed as a driving roller, the transfer belt 3 is driven for rotation in a direction indicated by an arrow A, and accordingly the other supporting rollers 4B, 4C, and 4D formed as driven rollers are driven for rotation.

In exactly the same manner as that of the image forming apparatus depicted in FIG. 1, the first to fourth image carriers 2Y, 2M, 2C, and 2BK have formed therein a yellow toner image, a magenta toner image, a cyan toner image, and a black toner image. These toner images are sequentially superposed for transfer on a recording medium P fed in an arrow B direction from a paper feeding device 16 and carried and conveyed on the transfer belt 3. When the recording medium having transferred thereon the toner image passes through the fixing device 19, that toner image is fixed to the recording medium. The recording medium passing through the fixing device 19 is then delivered to the paper delivery unit 22. On the other hand, toner attached to the transfer belt 3 is removed by the cleaning device 24.

Other basic configuration of the transfer unit 27 is substantially identical to the transfer unit depicted in FIG. 2. The transfer unit 27 depicted in FIG. 3 is also removably mounted on the image forming apparatus body 1.

As explained above, an image forming apparatus of the direct transfer type includes a transfer unit and an image carrier on which a toner image is formed, and is configured such that a toner image formed on an image carrier is directly transferred onto a recording medium carried and conveyed by a transfer belt of a transfer unit to obtain a recorded image.

Next, a specific configuration example of the supporting rollers 4A, 4B, 4C and 4D depicted in FIGS. 1 and 3 and a configuration example of a conventional roller are clearly explained. Here, in the following explanation, when particular identification of these supporting rollers 4A to 4D is not required, these supporting rollers are provided with a reference number 4 for collectively explaining the configurations of these supporting rollers.

Figure 12:
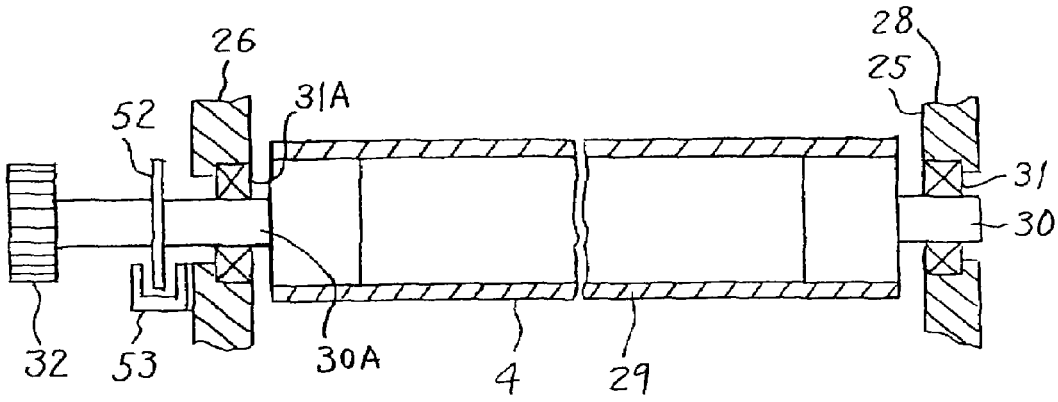
FIG.12 RELATED ART
FIG. 12 is a cross-section view of a conventional transfer unit.

FIG. 12 is a cross-section view of a conventional supporting roller 4 explained above. The supporting roller 4 depicted here includes a cylindrical member 29 and a pair of shaft members 30 and 30A press-fitted inside the cylindrical member from an opening of each end in a longitudinal direction of the cylindrical member 29. Small-diameter portion of the shaft members 30 and 30A are rotatably supported via the bearings 31 and 31A to the front side plate 25 and the rear side plate 26 of the unit frame 28, respectively. Also, when the supporting roller 4 is a driving roller, a gear 32 is fixed to one shaft member 30A. With this gear 32 being engaged with a counterpart gear not shown, the rotation of a driving motor not shown is transferred via these gears to the shaft member 30A, thereby driving the supporting roller 4 for rotation.

According to the conventional supporting roller 4 explained above, if the center axis line of the shaft members 30 and 30A is significantly decentered with respect to the center axis line of the cylindrical member 29, periodical speed fluctuations occur to the transfer belt wound around the supporting roller 4 and driven for rotation, thereby eventually causing density unevenness or a color shift in a toner image transferred on a recording medium. To get around this problem, the shaft members 30 and 30A are required to be manufactured so that the center axis line of the shaft members 30 and 30A accurately matches with the center axis line of the cylindrical member 29. Manufacturing cost of such shaft members, however, is high. Therefore, the conventional transfer unit inevitably has a drawback of increasing cost.

Figure 4:
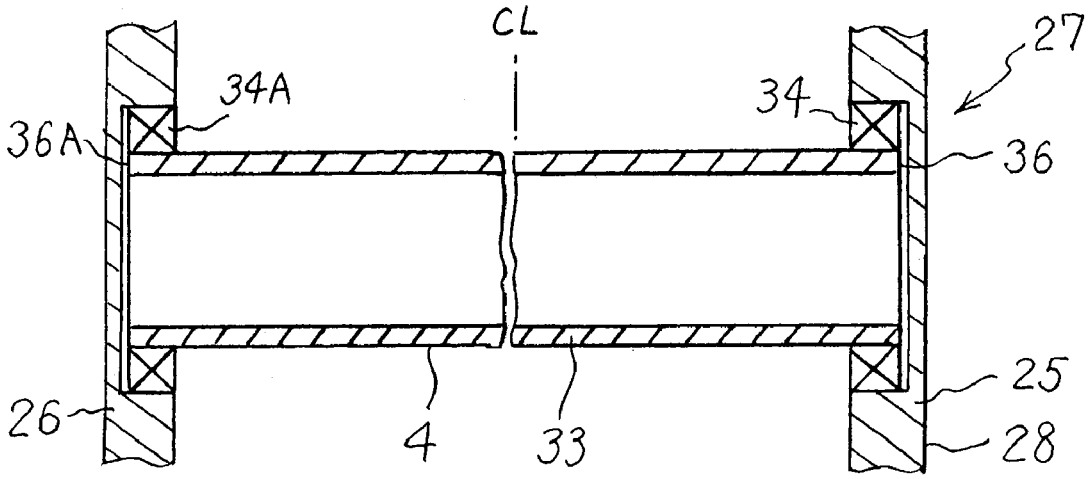
FIG. 4 is a cross-section view of a transfer unit having a supporting roller and a unit frame.

FIG. 4 is a cross-section view of an example of the supporting roller 4 of the transfer unit 27 in the present example. The supporting roller 4 depicted herein includes a cylindrical member 33 having an approximately same outer diameter throughout its length, and the cylindrical member includes one end in a longitudinal direction that is rotatably supported to the front side plate 25 of the unit frame 28 via a bearing 34, and the other end in a longitudinal direction that is rotatably supported to the rear side plate 26 via a bearing 34A. The shaft members 30 and 30A of the conventional supporting roller depicted in FIG. 12 are not provided, and each end of the cylindrical member 33 is rotatably supported to the unit frame 28 without via a shaft member.

As explained above, since the supporting roller 4 depicted in FIG. 4 does not have any shaft members, the cost can be reduced, and also the cost of the transfer unit 27 can be reduced. Furthermore, at the time of manufacturing the supporting roller 4, an operation of press-fitting shaft members into the cylindrical member 33 is not required, thereby also reducing the cost of the supporting roller 4 and in turn the cost of the transfer unit 27. With only an increase in accuracy of the cylindrical member 33, the occurrence of speed unevenness of the transfer belt 3 can be inhibited, thereby increasing image quality of an image formed on the recording medium.

The supporting roller 4 of the transfer unit 27 depicted in FIG. 4 includes the cylindrical member 33 with its outer perimeter surface being supported to the unit frame 28 via the bearings 34 and 34A. In the transfer unit 27 depicted in FIG. 5, supporting protrusions 35 and 35A with its horizontal cross-section view being formed in a circle are provided to protrude from the front side plate 25 and the rear side plate 26 of the unit frame 28. The inner perimeter surfaces of the ends of the cylindrical member 33 in the longitudinal direction are rotatably supported to the supporting protrusions 35 and 35A via the bearings 34 and 34A, respectively. Also with this supporting roller 4, the same effects as those of the supporting roller depicted in FIG. 4 can be achieved.

Figure 5:
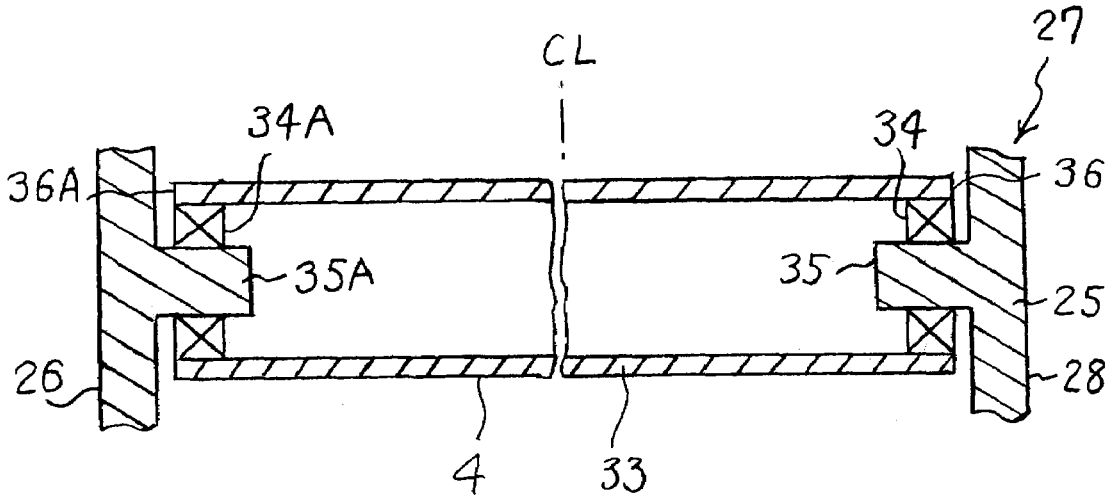
FIG. 5 is a cross-section view of another example of the transfer unit.

Here, the ends of the cylindrical member 33 in the longitudinal direction rotatably supported to the unit frame 28 are not restricted to the portions of the cylindrical member depicted in FIGS. 4 and 5 adjacent to end faces 36 and 36A of the cylindrical member 33. The point is that each end can be portions of the cylindrical member on a side of a relevant one of the end faces 36 and 36A from a center CL in the longitudinal direction of the cylindrical member 33. The same goes for specific cases that will be explained below.

When the supporting roller 4 depicted in FIG. 4 or 5 is applied to the supporting roller 4A formed of a driving roller depicted in FIGS. 1 and 3, the configuration can be such that, for example, a gear not shown is fixed to an end of an outer perimeter surface of the cylindrical member 33, this gear is engaged with a driving gear, and then the rotation of a driving motor not shown is transferred via these gears to the supporting roller 4. The same goes for the case of a supporting roller 4 depicted in FIG. 11.

Figure 6:
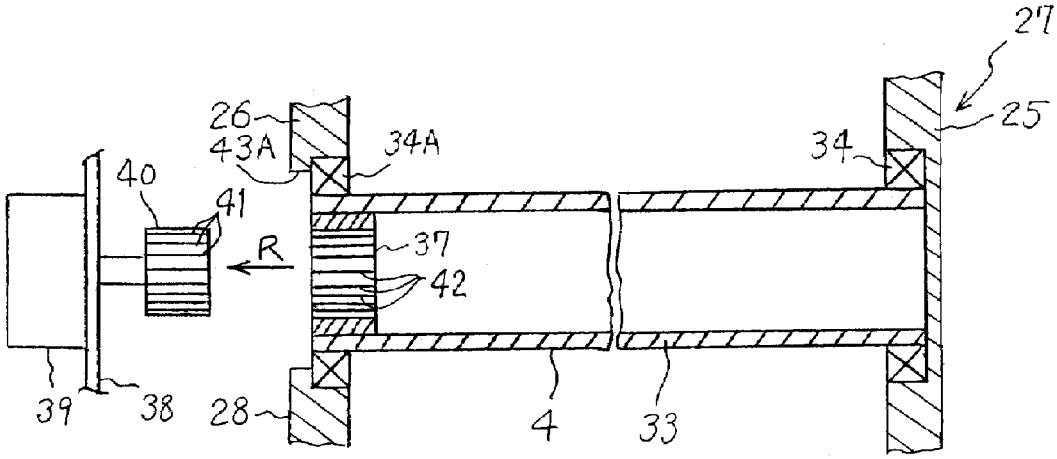
FIG. 6 is a cross-section view of still another example of the transfer unit.

FIG. 6 is a cross-section view of a supporting roller 4 applied to the driving roller 4A depicted in FIGS. 1 and 3. The supporting roller 4 depicted herein also includes the cylindrical member 33 configured similarly to the cylindrical member depicted in FIG. 4, and a driven member 37 is fixed inside the cylindrical member 33. That is, the supporting roller 4 includes the cylindrical member 33 and the driven member 37 fixed to the cylindrical member 33. Also, the unit frame 28 includes the rear side plate 26 having formed thereon a through hole 43A. Other configuration of the transfer unit 27 depicted in FIG. 6 is the same as that of the transfer unit depicted in FIG. 4.

When the transfer unit 27 depicted in FIG. 6 is adopted, a driving member 39 is fixedly supported to a rear side plate 38 on a depth side of the image forming apparatus body, and a driving member 40 is fixed to its output shaft. The driving member 40 depicted by way of example in FIG. 6 is formed of a cylindrical member having formed on its outer perimeter surface an external gear 41, and the driven member 37 is formed of an annular member having formed on its inner perimeter surface an internal gear 42. The outer perimeter surface of the driven member 37 is fixed to the inner perimeter surface of the cylindrical member 33.

As indicated by an arrow R in FIG. 6, when the transfer unit 27 is pressed in the depth direction of the image forming apparatus body 1 for mounting, the driving member 39 enters the inside of the driven member 37, and thus the internal gear 42 of the driven member 27 and the external gear 41 of the driving member 39 are engaged with each other. When the driving member 39 is then activated in this state, the rotation is transferred via the driving member 40 and the driven member 37 to the supporting roller 4, thereby driving the supporting roller 4 for rotation.

As explained above, the driving member 40 provided on the image forming apparatus body 1 side is engaged with the inside of the cylindrical member 33 of the supporting roller 4 depicted in FIG. 6, and the driven member 37 driven by the driving member 40 for rotation is fixed. According to the transfer unit 27 having this supporting roller 4, the driven member 37 is disposed inside the cylindrical member 33. Therefore, the entire configuration of the transfer unit 27 can be downsized. When this transfer unit 27 is packed for transportation, a packing box can also be downsized. Furthermore, the driven member 37 does not protrude outside the cylindrical member 33. Therefore, when the transfer unit 27 is transported, an inconvenience can be prevented where the driven member 37 may be bumped against another object to be damaged.

In the case of the transfer unit depicted in FIG. 12, the gear 32 is exposed to the outside of the cylindrical member 29. Therefore, when such a transfer unit is packed, the transfer unit becomes bulky. Moreover, at the time of transporting the transfer unit, the gear 32 may be bumped against another object to be damaged. According to the transfer unit 27 having the supporting roller 4 depicted in FIG. 6, the occurrence of such an inconvenience can be prevented.

On the other hand, the front side plate 25 and the rear side plate 26 forming the unit frame 28 of the transfer unit 27 depicted in FIGS. 7 to 10 have formed therethrough through holes 43 and 43A, respectively, communicating with an inner side of the cylindrical member 33.

Figure 7:
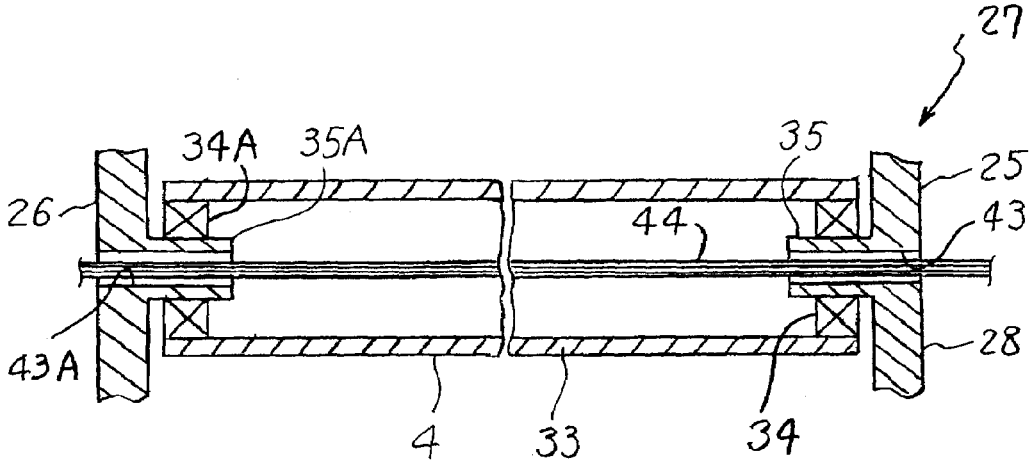
FIG. 7 is a cross-section view of still another example of the transfer unit.

Here, in a supporting roller 4 depicted in FIG. 7, as with the supporting roller depicted in FIG. 5, its cylindrical member 33 is rotatably supported to the supporting protrusions 35 and 35A protruding from the front side plate 25 and the rear side plate 26 of the unit frame 28 via the bearings 34 and 34A, respectively. The supporting protrusions 35 and 35A have formed therethrough the through holes 43 and 43A, respectively. Moreover, a harness 44 extends through the through holes 43 and 43A and the inner side of the cylindrical member 33. To the unit frame 28 of the transfer unit 27 depicted in FIGS. 1 and 3, the transfer rollers 12 are rotatably supported. For these rollers, the harness 44 is required to apply a transfer voltage. With the harness 44 through the cylindrical member 33 depicted in FIG. 7, no large space is required to be ensured inside the transfer unit 27 for routing, thereby easily routing the harness 44. That is, the inner space of the cylindrical member 33 can be effectively used for routing the harness 44.

Figure 8:
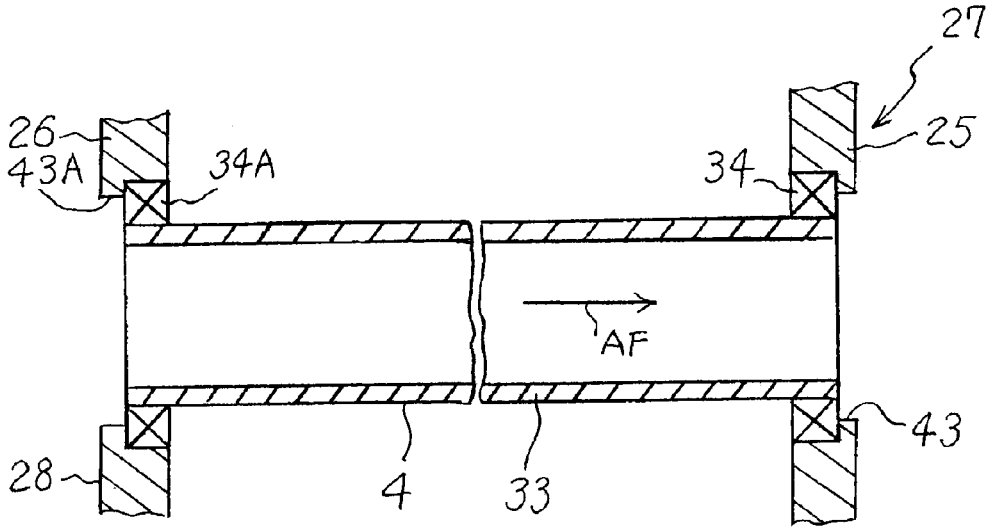
FIG. 8 is a cross-section view of another example of the transfer unit.

On the other hand, the cylindrical member 33 of a supporting roller 4 depicted from FIGS. 8 to 10 includes, as with the cylindrical member depicted in FIG. 4, outer perimeter surfaces of ends in a longitudinal direction being rotatably supported to the front side plate 25 and the rear side plate 26 of the unit frame 28 via the bearings 34 and 34A, respectively. Here, the inner side of the through holes 43 and 43A formed on the front side plate 25 and the rear side plate 26 of the unit frame 28 depicted in FIGS. 8 to 10 forms an airflow path, as depicted in an arrow AF.

As depicted in FIGS. 1 and 3, the fixing device 19 is provided near the transfer unit 27. When the transfer belt 3 is heated by heat generated at the fixing device 19 and heat at the time of operation of the transfer belt 3, toner may be attached to the transfer belt 3 or physical property values of the transfer belt 3 may be changed, thereby causing an abnormal image. According to the supporting roller 4 depicted in FIGS. 8 to 10, air flows through the inner side of the cylindrical 33, thereby effectively cooling the supporting roller 4, preventing an increase in temperature of the transfer belt 3 wound around the supporting roller 4, and preventing the occurrence of such an abnormal image.

Figure 9A:
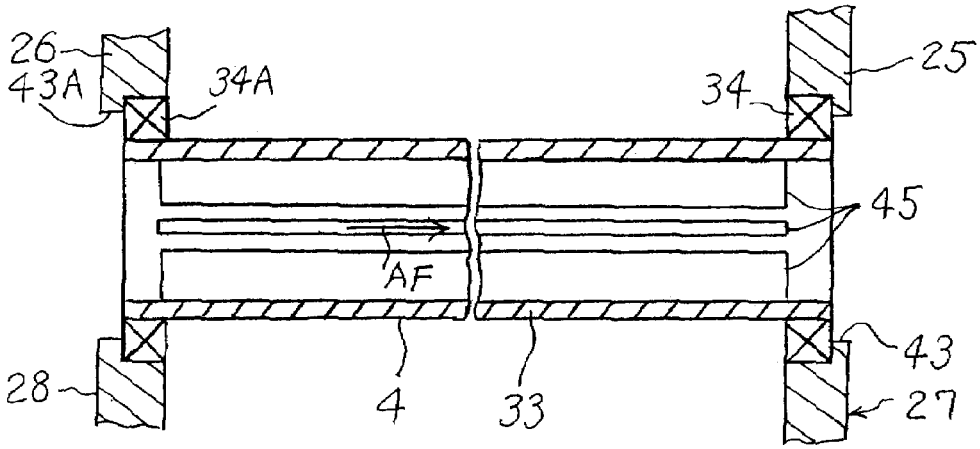
FIG. 9A is a vertical cross-section view of another example of the transfer unit.
Figure 9B:
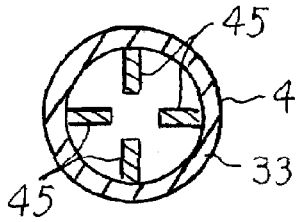
FIG. 9B is a lateral cross-section view of its supporting roller.

Although the cylindrical member 33 depicted in FIG. 8 does not have provided therein a special member, the cylindrical member 33 depicted in FIGS. 9A and 9B has fixed to its inside a base end of a heat-dissipating member 45 extending in a longitudinal direction. That is, the supporting roller 4 includes the cylindrical member 33 and the heat-dissipating member 45 fixed to the cylindrical member 33. Thus, with air circulating the inside of the cylindrical member 33, the supporting roller 4 can be effectively cooled, thereby more reliably preventing an excessive increase in temperature of the transfer belt 3.

Figure 10A:
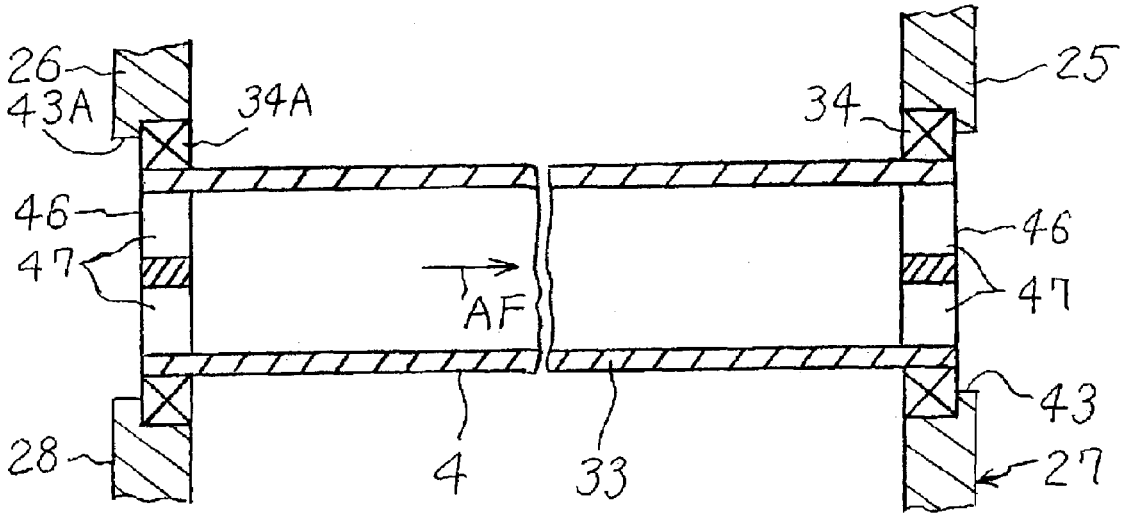
FIG. 10A is a vertical cross-section view of still another example of the transfer unit.
Figure 10B:
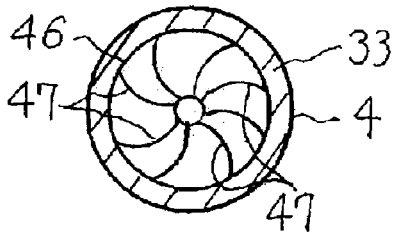
FIG. 10B is a lateral cross-section view of its supporting roller.

Also, the cylindrical member 33 depicted in FIGS. 10A and 10B has fixed to its inside blades 47 forming a fan 46. That is, the supporting roller 4 includes the cylindrical member 33 and the fan 46 fixed to the cylindrical member 33. Thus, when the supporting roller 4 is rotated, an airflow actively occurs inside the cylindrical member 33. With this airflow, the supporting roller 4 can be more effectively cooled, thereby more reliably preventing the occurrence of an abnormal image. Furthermore, a dedicated fan for sending air inside the cylindrical member 33 is not required, thereby suppressing an increase in cost of the image forming apparatus.

The cylindrical member 33 of the supporting roller 4 explained above can be formed of any appropriate material, for example, metal or resin. In particular, when the cylindrical member 33 is formed of aluminum, the cooling effect on the cylindrical member 33 can be increased. Aluminum has a higher thermal conductivity than metals, such as stainless steel and iron. Therefore, by manufacturing the cylindrical member 33 with aluminum, its cooling effect can be increased.

Figure 11:
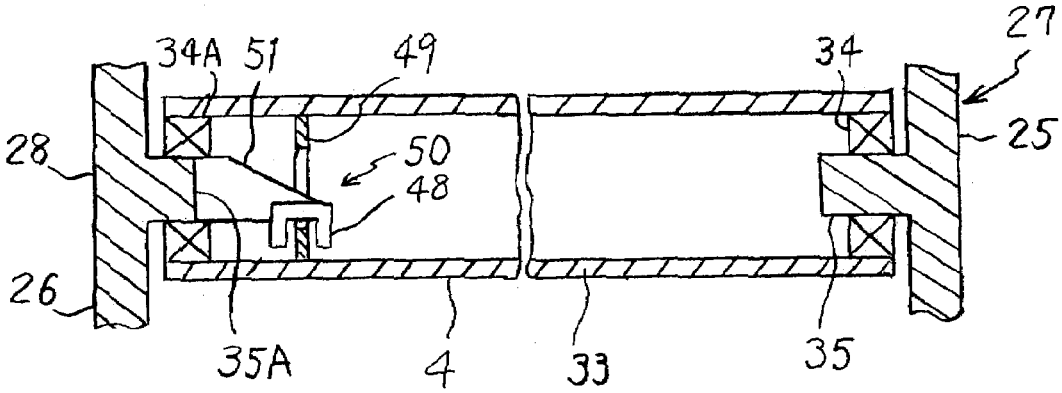
FIG. 11 is a cross-section view of still another example of the transfer unit.

The cylindrical member 33 of the transfer unit 27 depicted in FIG. 11 is, as with the cylindrical member depicted in FIG. 3, rotatably supported by the supporting protrusions 35 and 35A protruding from the front side plate 25 and the rear side plate 26 of the unit frame 28 via the bearings 34 and 34A, respectively. Furthermore, a rotation detecting device 50 is provided inside the cylindrical member 33, the device being formed of a photosensor 48 and a detection plate 49. The photosensor 48 is supported by a bracket 51 fixed to the inside of the bearing 34A without rotation. The detection plate 49 is formed in a ring shape with many slits extending in a radius direction. This detection plate 49 is fixed to the inner perimeter surface of the cylindrical member 33. In this manner, the supporting roller 4 includes not only the cylindrical member 33 but also the detection plate 49 of the rotation detecting device 50. When the supporting roller 4 is rotated, the detection plate 49 is also rotated together with the cylindrical member 33, but the photosensor 48 does not rotate. Therefore, the photosensor 48 detects a slit of the detection plate 49. With this, the number of times of rotation of the cylinder member 33 per unit time can be detected. When the detection results are different from a predetermined number of times of rotation, the rotation of the driving motor not depicted in FIG. 11 is adjusted. With this, a surface linear velocity of the transfer belt 3 is kept at a predetermined correct value, thereby forming a toner image of high quality on the transfer belt 3 or the recording medium carried thereby.

As explained above, since the rotation detecting device 50 is provided inside the cylindrical member 33, the upsizing of the transfer unit 27 can be prevented. Also, a situation can be eliminated such that the photosensor 48 and the detection plate 49 are touched by human hand or the like to be damaged.

A rotation detecting device of a conventional transfer unit includes a detection plate 52 fixed to one shaft member 30A and a photosensor 53 fixed to the rear side plate 26 of the unit frame 28, as depicted in FIG. 12. When the cylindrical member 29 is rotated, the photosensor 53 detects a slit of the detection plate 52 to detect the number of times of rotation of the supporting roller 4 per unit time. According to this rotation detecting device, the detection plate 52 and the photosensor 53 are provided outside of the cylindrical member 29. Therefore, the transfer unit is upsized, and therefore the detection plate 52 and the photosensor 53 may be touched by human hand. According to the transfer unit 27 depicted in FIG. 11, such an inconvenience can be prevented.

The configuration of the supporting roller 4 depicted in FIGS. 4 to 11 can be applied to all of the supporting rollers 4A, 4B, 4C, and 4D that support the transfer belt 3 depicted in FIGS. 1 and 3. However, the predetermined objects of the present invention can be achieved by applying the present invention only to a part of the supporting rollers. That is, the configuration explained above can be adopted to at least one of the supporting rollers having a transfer belt wound therearound. Also, a coating layer or a rubber layer may be provided on an outer perimeter surface of the supporting roller.

As describe above, according to one aspect of the present invention, it is possible to provide a transfer unit capable of effectively suppressing the occurrence of density unevenness and color shift of a toner image transferred onto a recording medium and also capable of reducing cost, and an image forming apparatus having such a transfer unit.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer unit comprising:
a plurality of supporting rollers;
a transfer belt that is driven by the supporting rollers;
a unit frame that supports the supporting rollers in a rotatable manner, wherein
at least one of the supporting rollers includes a cylindrical member having a substantially same outer diameter over an entire length thereof,
each end portion of the cylindrical member in a longitudinal direction is supported by the unit frame via a bearing in a rotatable manner, and
the unit frame includes a through hole communicating with the inside of the cylindrical member.

2. The transfer unit according to claim 1, wherein the cylindrical member includes a driven member that is engaged with a driving member provided on a main body of an image forming apparatus and driven by the driving member in a rotatable manner.

3. The transfer unit according to claim 1, wherein the through hole and the inside of the cylindrical member form an airflow path.

4. The transfer unit according to claim 3, wherein the cylindrical member includes a heat-dissipating member, said heat dissipating member includes a plurality of elongated members fixed to an inside surface of the cylindrical member.

5. The transfer unit according to claim 3, wherein the cylindrical member includes a plurality of arcuate blades that form a fan.

6. The transfer unit according to claim 1, wherein the cylindrical member is made of aluminum.

7. A transfer unit comprising:
a plurality of supporting rollers;
a transfer belt that is driven by the supporting rollers;
a unit frame that supports the supporting rollers in a rotatable manner, wherein
at least one of the supporting rollers includes a cylindrical member having a substantially same outer diameter over an entire length thereof,
each end portion of the cylindrical member in a longitudinal direction is supported by the unit frame via a bearing in a rotatable manner, and
the unit frame includes a through hole communicating with the inside of the cylindrical member, wherein a harness extends along the through hole and the inside of the cylindrical member.

8. A transfer unit comprising:
a plurality of supporting rollers;
a transfer belt that is driven by the supporting rollers;
a unit frame that supports the supporting rollers in a rotatable manner, wherein
at least one of the supporting rollers includes a cylindrical member having a substantially same outer diameter over an entire length thereof,
each end portion of the cylindrical member in a longitudinal direction is supported by the unit frame via a bearing in a rotatable manner, wherein the cylindrical member includes a rotation detecting unit that detects number of rotations of the cylindrical member per unit time, and
the rotation detection unit includes a photosensor mounted on a bracket projecting from the unit frame.

9. An image forming apparatus comprising:
a transfer unit that includes
a plurality of supporting rollers,
a transfer belt that is driven by the supporting rollers,
a unit frame that supports the supporting rollers in a rotatable manner, wherein
at least one of the supporting rollers includes a cylindrical member having a substantially same outer diameter over an entire length thereof,
each end portion of the cylindrical member in a longitudinal direction is supported by the unit frame via a bearing in a rotatable manner,
the unit frame includes a through hole communicating with the inside of the cylindrical member; and
an image carrier on which a toner image is formed, wherein
the toner image formed on the image carrier is transferred onto the transfer belt of the transfer unit for a primary transfer, and the toner image on the transfer belt is transferred onto a recording medium for a secondary transfer to obtain a recorded image.

10. An image forming apparatus comprising:
a transfer unit that includes
a plurality of supporting rollers,
a transfer belt that is driven by the supporting rollers,
a unit frame that supports the supporting rollers in a rotatable manner, wherein
at least one of the supporting rollers includes a cylindrical member having a substantially same outer diameter over an entire length thereof, each end portion of the cylindrical member in a longitudinal direction is supported by the unit frame via a bearing in a rotatable manner, the unit frame includes a through hole communicating with the inside of the cylindrical member; and an image carrier on which a toner image is formed, wherein the toner image formed on the image carrier is transferred onto a recording medium carried by the transfer belt to obtain a recorded image.

* * * * *